United States Patent [19]

Marshall et al.

[11] 4,210,700

[45] Jul. 1, 1980

[54] PRODUCTION OF POLYESTER YARN

[75] Inventors: Robert M. Marshall, Chester; Kimon C. Dardoufas, Richmond, both of Va.

[73] Assignee: Allied Chemical Corporation, Morris Township, Morris County, N.J.

[21] Appl. No.: 942,583

[22] Filed: Sep. 15, 1978

[51] Int. Cl.[2] ..... D02G 3/48; B05D 1/24; B32B 17/04

[52] U.S. Cl. ..... 428/395; 252/8.7; 252/8.8; 252/8.9; 156/110 A; 427/175; 427/434.6

[58] Field of Search ..... 57/257 R; 152/355, DIG. 14; 252/8.9, 8.8; 156/110 A, 110 C; 264/210 F; 427/434 D, 175; 428/395

[56] References Cited

U.S. PATENT DOCUMENTS

| | | | |
|---|---|---|---|
| 1,970,578 | 8/1934 | Schoeller et al. . | |
| 2,565,403 | 8/1951 | Sproule et al. . | |
| 2,842,462 | 7/1958 | Haas et al. . | |
| 3,004,056 | 10/1961 | Nunn, Jr. et al. . | |
| 3,004,057 | 10/1961 | Nunn, Jr. . | |
| 3,113,369 | 10/1963 | Barrett et al. . | |
| 3,198,732 | 8/1965 | Olney . | |
| 3,248,258 | 4/1966 | Coats . | |
| 3,306,850 | 2/1967 | Olsen . | |
| 3,341,451 | 9/1967 | Dzjuba et al. . | |
| 3,341,452 | 9/1967 | Cooley . | |
| 3,434,874 | 3/1969 | Proffitt, Jr. . | |
| 3,470,095 | 9/1969 | Pontelandolfo . | |
| 3,503,880 | 3/1970 | McMicken . | |
| 3,563,892 | 2/1971 | Cooley . | |
| 3,575,856 | 4/1971 | Anton . | |
| 3,619,274 | 11/1971 | Proffitt, Jr. . | |
| 3,630,259 | 12/1971 | Brignac . | |
| 3,672,977 | 6/1972 | Dardoufas . | |
| 3,681,244 | 8/1972 | Obetz et al. . | |
| 3,687,721 | 8/1972 | Dardoufas . | |
| 3,781,202 | 12/1973 | Marshall et al. . | |
| 3,785,973 | 1/1974 | Bernholl et al. | 252/8.8 |
| 3,788,888 | 1/1974 | Kawanaka et al. . | |
| 3,803,035 | 4/1974 | Bhakuni et al. | 252/8.9 |
| 3,926,816 | 12/1975 | Cohen et al. | 252/8.9 |
| 4,027,346 | 6/1977 | Wada et al. | 8/30 |
| 4,039,715 | 8/1977 | Carver | 428/375 |
| 4,069,160 | 1/1978 | Hawkins | 252/8.9 |
| 4,072,617 | 2/1978 | Jahn | 252/8.9 |
| 4,103,068 | 2/1978 | Marshall et al. | 428/395 |
| 4,105,568 | 7/1978 | Marshall et al. | 252/8.6 |

OTHER PUBLICATIONS

Abstract/Def. Pub. T905,013, 12/19/72 Welsh et al. (Found In O.G. 12/19/72 vol. 905).

Abstract/U.S.S.R. 491,645, Chemical Abstracts vol. 84 (1976) pp. 46463–464645.

Abstract/Japan Kokai 67,592, Chemical Abstracts vol. 80(1974) pp. 16369–16359m.

*Primary Examiner*—Shrive P. Beck
*Assistant Examiner*—Thurman K. Page
*Attorney, Agent, or Firm*—Fred L. Kelly

[57] ABSTRACT

An improved multifilament polyethylene terephthalate yarn is prepared by first applying to the yarn a liquid composition comprising hexadecyl stearate, refined coconut oil, ethoxylated tallow amine, ethoxylated lauryl alcohol, sodium salt of alkylarylsulfonate, dinonylsodium-sulfosuccinate, and a mineral oil, and then applying to the yarn a liquid composition which is an oil-in-water emulsion, the oil portion of which comprises coconut oil, polyoxyethylene hydrogenated castor oil, and phosphated polyoxyethylated tridecyl alcohol neutralized with potassium hydroxide. The yarn is preferably used in tire cords for the construction of pneumatic passenger tires and results in excellent adhesion of tire cord to rubber.

3 Claims, No Drawings

PRODUCTION OF POLYESTER YARN

CROSS-REFERENCE TO RELATED APPLICATION

This application is related to our U.S. Application Ser. No. 859,762, filed Dec. 12, 1977, now U.S. Pat. No. 4,126,564.

BACKGROUND OF THE INVENTION

This invention relates to multifilament polyester yarns and particularly to improved multifilament polyethylene terephthalate yarns for industrial uses. More particuarly, it relates to an improved multifilament polyethylene terephthalate yarn and a new fiber finishing process for polyethylene terephthalate yarns. Still more particularly, it relates to a fiber finish composition designed specifically for subsequent tire cord processing for polyethylene terephthalate yarns, and the eventual production of pneumatic passenger car tires.

The prior art is replete with fiber finish compositions, some of which are quite specific in composition and relate to specific types of fibers. Small changes in a given fiber finish composition or in its application during a fiber-manufacturing process can and frequently do result in tremendous improvements in both processing and end use of the fiber.

Polyester industrial yarn finishes generally comprise a combination of a lubricant, an antistat, and several emulsifiers. For example, U.S. Pat. No. 3,672,977 to K. C. Dardoufas, discloses an improved polyester industrial yarn which is produced by first treating the yarn with a spin finish comprising hexadecyl stearate, refined coconut oil, ethoxylated tallow amine, ethoxylated lauryl alcohol, sodium salt of alkylarylsulfonate, dinonyl-sodium-sulfosuccinate, 4,4'-thio-bis-(3-methyl-6-tert-butylphenol) and white mineral oil, and then treating the yarn with an overfinish comprising glycerol monooleate, decaglycerol tetraoleate, ethoxylated tall oil fatty acids, sulfated glycerol trioleate, ethoxylated tallow amine and hexadecyl stearate.

Following its production by either the above-described process or some other process, the polyester yarn may undergo further processing or treatment depending on the desired end use. For example, in the production of tire cord, polyester yarn is normally plied, then twisted, and treated with one or two dips. Dip treatment has as one of its objectives acceptable adhesion of the cord and rubber in the ultimate product, e.g., pneumatic tires. High temperatures are usually employed in the curing of each dip treatment. Unfortunately, the yarn finish or overfinish of U.S. Pat. No. 3,672,977 is based on volatile lubricants which burn off or fume at the temperatures required to cure the dip treatment or treatments. Similar results obtain from other high temperature treatment of the yarn. This emission of fumes, naturally, is of great concern to industry due to the associated health and environmental problems—a subject of governmental regulation of the past few years.

With this framework in mind, research was undertaken to produce a yarn finish or overfinish which would significantly reduce emissions. This has been accomplished by the present invention. Surprisingly, however, not only were emissions reduced, but the additional benefit of increased adhesion, to be discussed later, was obtained.

The closest prior art known to the inventors is U.S. Pat. No. 4,069,160, which discloses an improved, low fuming, thermally stable, texturing finish for a synthetic filamentary material, comprising a lubricant, an emulsifier, an antistat-auxiliary emulsifier, and optionally, a thermal stabilizer.

This patent, however, does not teach the present invention, which will be more clearly understood upon reference to the description and examples which follow.

SUMMARY OF THE INVENTION

It is a primary object of the present invention to provide an improved multifilament, continuous filament polyethylene terephthalate yarn and an improved process for preparing the yarn for reinforcing pneumatic car tires, by using first, a composition for use as a process finish, followed by an improved composition for use as an overfinish to yield the desired yarn cord properties.

It is a further object of this invention to provide a two-part fiber finish composition, particularly for application to polyethylene terephthalate yarn prepared by a process involving spinning and drawing steps, wherein the composition of the second finish or overfinish has excellent stability to high temperature process conditions to significantly reduce emissions during treatment.

These and other objects of this invention are provided by an improved process for the production of a novel polyethylene terephthalate yarn. The improved process comprises the steps of first treating the yarn with from about 0.3 to about 0.6 weight percent based on the weight of the yarn of a liquid composition consisting essentially of about 10 to about 20 weight percent of the composition of each hexadecyl stearate and refined coconut oil, about 3.0 to about 6.0 weight percent of the composition of ethoxylated tallow amine, about 10 to about 20 weight percent of the composition of ethoxylated lauryl alcohol, about 8.0 to about 12.0 weight percent of the composition of sodium salt of alkylarylsulfonate, about 1.0 to about 3.0 weight percent of the composition of dinonyl-sodium-sulfosuccinate, and about 35 to 50 weight percent of the composition of white mineral oil having a boiling point of between about 265° C. (510° F.) and 327° C. (620° F.) and a viscosity of between 38 to 40 SSU at about 38° C. (120° F.) wherein at least about 0.15 to about 0.30 weight percent is retained on the yarn; and then the yarn is treated with from about 0.7 to about 1.2 weight percent based on the weight of the yarn of a liquid composition which is an oil-in-water emulsion of about 10 to 20 percent by weight of the oil portion, the oil portion consisting essentially of from about 55 to 65 percent by weight of coconut oil, about 20 to 35 percent by weight of polyoxyethylene hydrogenated castor oil, and about 7 to 15 percent by weight of phosphated polyoxyethylated tridecyl alcohol, neutralized with potassium hydroxide. Preferably, the coconut oil is refined coconut glyceride, the ethoxylated hydrogenated castor oil contains about 14 to 18 moles of ethylene oxide per mole of hydrogenated castor oil, and the phosphated ethoxylated tridecyl alcohol, neutralized with potassium hydroxide, contains about 4 to 6 moles of ethylene oxide per mole of phosphated tridecyl alcohol, neutralized with potassium hydroxide.

DESCRIPTION OF THE PREFERRED EMBODIMENTS

Table I shows the overfinish composition of the preferred embodiment of this invention. Table II shows the criticality of overfinish components to emulsion stability. Table III shows the criticality of the amounts of components necessary in order to provide a stable emulsion. Note that only the overfinish identified as A in both of Tables II and II provides excellent emulsion stability after 48 hours. Varying the components (Table II) results in poor emulsion stability, and varying the amounts of the various components (Table III) results in only fair or poor emulsion stability.

TABLE I

| OVERFINISH COMPOSITION | Weight Percent |
|---|---|
| Refined coconut glyceride | 60 |
| Polyoxyethylene (16)[a] hydrogenated castor oil | 30 |
| Phosphated polyoxyethylated (5)[a] tridecyl alcohol, neutralized with potassium hydroxide | 10 |

a = Moles of ethylene oxide per mole of base material

TABLE II

| OVERFINISH COMPONENTS | OVERFINISH COMPOSITIONS WEIGHT PERCENT | | | | | | | | | | | | | | | | |
|---|---|---|---|---|---|---|---|---|---|---|---|---|---|---|---|---|---|
| | A | B | C | D | F | G | H | I | J | K | L | M | N | O | P | Q | R |
| Refined Coconut Glyceride | 60 | 60 | 60 | 60 | 60 | 60 | 60 | 60 | 60 | 60 | 60 | 60 | 60 | 60 | 60 | 60 | 60 |
| Polyoxyethylene (16)[a] Hydrogenated Castor Oil | 30 | — | — | — | — | — | — | — | — | — | — | — | — | — | — | — | — |
| Polyoxyethylene (5)[a] Castor Oil | — | 30 | — | — | — | 13 | 15 | 10 | 20 | 10 | 10 | 10 | 10 | 10 | 10 | 10 | 10 |
| Polyoxyethylene (15)[a] Castor Oil | — | — | 30 | — | — | — | — | — | — | — | — | — | — | — | — | — | — |
| Polyoxyethylene (25)[a] Castor Oil | — | — | — | 30 | — | 12 | 10 | 15 | 5 | 10 | 10 | 10 | 10 | 10 | 10 | 10 | 10 |
| Polyoxyethylene (40)[a] Castor Oil | — | — | — | — | 30 | — | — | — | — | — | — | — | — | — | — | — | — |
| Polyoxyethylene (5)[a] Pelargonate | — | — | — | — | — | — | — | — | — | 10 | — | — | — | — | — | — | — |
| Polyoxyethylene (10)[a] Pelargonate | — | — | — | — | — | — | — | — | — | — | 10 | — | — | — | — | — | — |
| Polyoxyethylene (5)[a] Laurate | — | — | — | — | — | — | — | — | — | — | — | 10 | — | — | — | — | — |
| Polyoxyethylene (8)[a] Laurate | — | — | — | — | — | — | — | — | — | — | — | — | 10 | — | — | — | — |
| Polyoxyethylene (14)[a] Laurate | — | — | — | — | — | — | — | — | — | — | — | — | — | 10 | — | — | — |
| Polyoxyethylene (10)[a] Oleyl Ether | — | — | — | — | — | — | — | — | — | — | — | — | — | — | 10 | — | — |
| Polyoxyethylene (10)[a] Oleate | — | — | — | — | — | — | — | — | — | — | — | — | — | — | — | 10 | — |
| Polyoxyethylene (14)[a] Oleate | — | — | — | — | — | — | — | — | — | — | — | — | — | — | — | — | 10 |
| Phosphated Polyoxyethylated (5)[a] Tridecyl Alcohol, Neutralized with Potassium Hydroxide. | 10 | 10 | 10 | 10 | 10 | 15 | 15 | 15 | 15 | 10 | 10 | 10 | 10 | 10 | 10 | 10 | 10 |
| Emulsion Stability * After 48 hours (Emulsion Contains 20 Percent by Weight of Oil Portion in Water). | E | P | P | P | P | P | P | P | P | P | P | P | P | P | P | P | P |

[a] = Moles of ethylene oxide per mole of base material.
*E = Excellent - Translucent bluish-white; particle size less than 1 micron. No separation.
*P = Poor - Chalky white; particle size above 4 microns. Creaming on Surface.

TABLE III

| OVERFINISH COMPONENTS | OVERFINISH COMPOSITIONS WEIGHT PERCENT | | | | | | | | |
|---|---|---|---|---|---|---|---|---|---|
| | A | B | C | D | E | F | G | H | |
| Refined Coconut Glyceride | 60 | 60 | 60 | 50 | 55 | 60 | 60 | 60 | Lubricant |
| Polyoxyethylene (16)[a] Hydrogenated Castor Oil | 30 | 25 | 35 | 30 | 25 | 20 | 17 | 23 | Emulsifier |
| Phosphated Polyoxyethylated (5)[a] Tridecyl Alcohol, Neutralized With Potassium Hydroxide | 10 | 15 | 5 | 20 | 20 | 20 | 23 | 17 | Antistat Emulsifier |
| Emulsion Stability* After 48 Hours (Emulsion Contains 20 Percent by Weight of Oil Portion in Water) | E | P | F | P | P | F | P | P | |

a = Moles of ethylene oxide per mole of base material.
*E = Excellent - Translucent bluish-white; particle size less than 1 micron. No separation.
*F = Fair - Milky white; particle size up to 4 microns. Slight ring of oil separation on surface.
*P = Poor - Chalky white; particle size above 4 microns. Creaming on surface.

The invention will now be further described in the following specific examples which are to be regarded solely as illustrative and not as restricting the scope of the invention. In the following examples, parts and percentages employed are by weight unless otherwise indicated.

EXAMPLE 1

For comparative testing, a polyethylene terephthalate tire yarn was prepared substantially as described in U.S. Pat. No. 3,672,977. A one thousand denier, 192 filament yarn was prepared comprised of polyethylene terephthalate filaments treated with about 0.45 percent based on the weight of the yarn of a liquid spin finish consisting of 15 parts refined coconut oil, 15 parts hexadecyl stearate, 13 parts ethoxylated lauryl alcohol, 10 parts sodium salt of alkylarylsulfonate, 5 parts ethoxylated tallow amine, 2 parts of dinonyl-sodium-sulfosuccinate, and 40 parts mineral oil having a boiling point between about 265° C. (510° F.) and 327° C. (620° F.). Drawing performance of the yarn was excellent. Finish oil remaining on the fiber was 0.2 weight percent.

An overfinish was then applied to the drawn yarn as described in U.S. Pat. No. 3,672,977. The overfinish was applied by means of a kiss roll to give a final total oil-on-yarn of 1.1 weight percent. The overfinish had the following composition: 65 parts hexadecyl stearate, 6 parts glycerol monooleate, 5 parts decaglycerol tetraoleate, 8 parts ethoxylated tall oil fatty acid, 12 parts sulfated glycerol trioleate, and 4 parts ethoxylated tallow amine. This yarn sample was designated Yarn A.

Another yarn sample was produced in the same manner described above except that the overfinish of Table I, above, was applied to the drawn yarn to give a final oil-on-yarn of 0.5 weight percent. This sample was designated Yarn B.

The two yarn samples were each twisted and plied into greige cord, and then exposed in a Litzler oven for 60 seconds at about 238° C. (460° F.). The finish loss is recorded in Table IV below:

TABLE IV

| Sample | Finish Loss Lbs. per Thousand Lbs. of Cord Processed |
|---|---|
| Yarn A (Control) | 5.6 |
| Yarn B | 0.7 |

An examination of Table IV shows that the composition of this invention is substantially non-fuming, i.e., it does not flash off in high temperature processing, and the overfinish lubricates the yarn even after passing through high temperature processing.

EXAMPLE 2

Polyethylene terephthalate yarns prepared in accordance with Example 1 were two-plied and twisted, treated with a blocked diisocyanate and resorcinol formaldehyde latex dips, and converted into pneumatic tires of conventional present day design, i.e. with a vulcanized rubberized fabric carcass of generally toroidal shape having a tread portion superimposed and bonded to the crown area of the carcass and plies of rubberized polyethylene terephthalate fabric forming side walls extending from the tread over the carcass to the bead portion. New, untested tires were cut into one inch strips perpendicular to the tread and the rubber was pulled away from the cord. Pulls were made on an Instron tester, both at room temperature and in a chamber heated to approximately 121° C. (250° F.). The amount of cord showing after the pull was the key measure of the cord to rubber adhesion. This property was evaluated visually and reported in a rating ranging from 1 to 5, wherein 1 was equivalent to all cord visible and no rubber remaining on cord—this represents very poor adhesion, and wherein 5 was equivalent to no cord visible—very good adhesion. Comparative testing of tires prepared from Yarn A (Control) and Yarn B produced the ratings shown in Table V. The ratings represent an average of twelve tests per yarn per temperature condition with a $\tau$ of 0.3 units. These data further confirm that tires prepared from Yarn B are significantly better than those prepared from Yarn A.

TABLE V

| Sample | Adhesion Rating | |
|---|---|---|
| | Room Temperature | 121° C. (250° F.) |
| Yarn A (Control) | 4.0 | 4.3 |
| Yarn B | 4.9 | 4.8 |

We claim:

1. A synthetic filamentary yarn comprised of polyethylene terephthlate filaments which are first treated with from about 0.3 to about 0.6 weight percent based on the weight of the yarn of a liquid composition consisting essentially of about 10 to about 20 weight percent of said composition of each hexadecyl stearate and refined coconut oil, about 3.0 to about 6.0 weight percent of said composition of ethoxylated tallow amine, about 10 to about 20 weight percent of said composition of ethoxylated lauryl alcohol, about 8.0 to about 12.0 weight percent of said composition of sodium salt of alkylarylsulfonate, about 1.0 to about 3.0 weight percent of said composition of dinonyl-sodium-sulfosuccinate, and about 35 to 50 weight percent of said composition of white mineral oil having a boiling point of between about 265° C. (510° F.) and 327° C. (620° F.) and a viscosity of between 38 to 40 SSU at about 38° C. (100° F.) wherein at least about 0.15 to about 0.30 weight percent is retained on said yarn; and then said yarn is treated with from about 0.7 to about 1.2 weight percent based on the weight of said yarn of a liquid composition which is an oil-in-water emulsion of about 10 to 20 percent by weight of said oil portion, said oil portion consisting essentially of from about 55 to 65 percent by weight of coconut oil, about 20 to 35 percent by weight of polyoxyethylene hydrogenated castor oil, and about 7 to 15 percent by weight of phosphated polyoxyethylated tridecyl alcohol, neutralized with potassium hydroxide.

2. A two-part fiber finish composition, particularly for application to polyethylene terephthalate yarn prepared by a process involving spinning and drawing steps, said two-part finish composition consisting of:

A. a first finish composition consisting essentially of about 10 to about 20 weight percent of said composition of each hexadecyl stearate and refined coconut oil, about 3.0 to about 6.0 weight percent of said composition of ethoxylated tallow amine, about 10 to about 20 weight percent of said composition of ethoxylated lauryl alcohol, about 8.0 to about 12.0 weight percent of said composition of sodium salt of alkyarylsulfonate, about 1.0 to about 3.0 weight percent of said composition of dinonyl-sodium-sulfosuccinate, and about 35 to 50 weight percent of said composition of white mineral oil have a boiling point of between about 265° C. (510° F.) and 327° C. (620° F.) and a viscosity between 38 to 40 SSU at about 38° C. (100° F.), said first finish composition being applied to the yarn prior to drawing said yarn; and B. a second finish composition which is an oil-in-water emulsion of about 10 to 20 percent by weight of said oil portion, said oil portion consisting essentially of from about 55 to 65 percent by weight of coconut oil, about 20 to 35 percent by weight of polyoxyethylene hydrogenated castor oil, and about 7 to 15 percent by weight of phosphated polyoxyethylated tridecyl alcohol, neutralized with potassium hydroxide, said second finish composition being applied as an overfinish to the yarn after drawing said yarn.

3. In a process for the production of a pneumatic passenger tire having a carcass constructed with a multiplicity of plies made from polyester cords, the cords being prepared from a yarn, and a tread made from rubber composition, the yarn being prepared by a process involving spinning and drawing steps, the improvement which comprises first treating the yarn during the spinning step with from about 0.3 to about 0.6 weight percent based on the weight of said yarn of a liquid composition consisting essentially of about 10 to about 20 weight percent of said composition of each hexadecyl stearate and refined coconut oil, about 3.0 to about 6.0 weight percent of said composition of ethoxylated tallow amine, about 10 to about 20 weight percent of said composition of ethoxylated lauryl alcohol, about 8.0 to about 12.0 weight percent of said composition of sodium salt of alkylarylsulfonate, about 1.0 to about 3.0 weight percent of said composition of dinonyl-sodium-sulfosuccinate, and about 35 to 50 weight percent of said composition of white mineral oil having a boiling point of between about 265° C. (510° F.) and 327° C. (620° F.) and a viscosity of between 38 to 40 SSU at about 38° C. (100° F.) wherein at least about 0.15 to about 0.30 weight percent is retained on said yarn; and then treating said yarn subsequent to the drawing step with from about 0.7 to about 1.2 weight percent based on the weight of said yarn of a liquid composition which is an oil-in-water emulsion of about 10 to 20 percent by weight of said oil portion, said oil portion consisting essentially of from about 55 to 65 percent by weight of coconut oil, about 20 to 35 percent by weight of polyoxyethylene hydrogenated castor oil, and about 7 to 15 percent by weight of phosphated polyoxyethylated tridecyl alcohol, neutralized with potassium hydroxide.

* * * * *